US006565799B1

(12) United States Patent
Kojo et al.

(10) Patent No.: US 6,565,799 B1
(45) Date of Patent: May 20, 2003

(54) EQUIPMENT FOR THE EVEN FEED OF PULVEROUS MATERIAL TO A CONCENTRATE BURNER OF SUSPENSION SMELTING FURNACE

(75) Inventors: Ilkka Kojo, Espoo (FI); Markku Lahtinen, Sipoo (FI); Kaarle Peltoniemi, Vantaa (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/979,450

(22) PCT Filed: May 12, 2000

(86) PCT No.: PCT/FI00/00433

§ 371 (c)(1),
(2), (4) Date: Nov. 13, 2001

(87) PCT Pub. No.: WO00/73519

PCT Pub. Date: Dec. 7, 2000

(30) Foreign Application Priority Data

May 31, 1999 (FI) ..... 991226

(51) Int. Cl.[7] ..... F27B 15/08

(52) U.S. Cl. ..... 266/182; 75/639; 266/267

(58) Field of Search ..... 266/182, 267; 75/639

(56) References Cited

U.S. PATENT DOCUMENTS

| | | | | |
|---|---|---|---|---|
| 4,326,702 A | * | 4/1982 | Oueneau et al. | 266/182 |
| 4,744,311 A | * | 5/1988 | Piekos | 110/108 |
| 5,181,955 A | | 1/1993 | Asteljoki | |
| 5,358,222 A | | 10/1994 | Kaasinen et al. | |
| 5,362,032 A | | 11/1994 | Ranki | |
| 5,674,310 A | | 10/1997 | Miralles et al. | |

FOREIGN PATENT DOCUMENTS

| | | |
|---|---|---|
| DE | 24 24 237 | 11/1975 |

* cited by examiner

*Primary Examiner*—Melvyn Andrews
(74) *Attorney, Agent, or Firm*—Smith-Hill and Bedell

(57) ABSTRACT

This invention relates to equipment for the feed of pulverous material to a concentrate burner of a suspension-melting furnace, so that the feed of solid finely divided material into the furnace is distributed evenly in the concentrate burner. According to the invention, a vibrating feeder is located between the raw material conveyor and the actual burner, and the concentrate burner feed pipes are equipped with blades for distributing the material.

13 Claims, 4 Drawing Sheets

Figure 1:
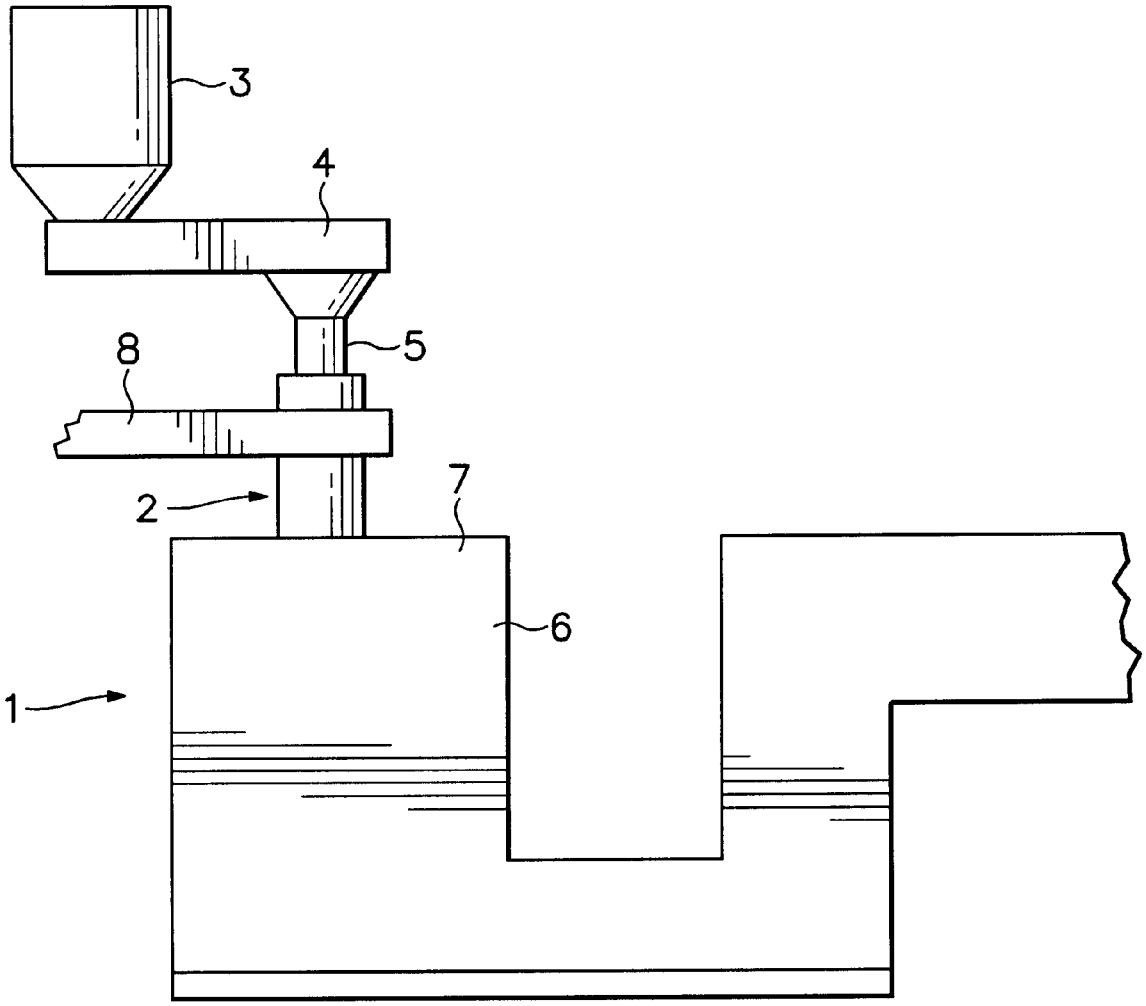

EQUIPMENT FOR THE EVEN FEED OF PULVEROUS MATERIAL TO A CONCENTRATE BURNER OF SUSPENSION SMELTING FURNACE

This invention relates to equipment for the feed of pulverous material to a concentrate burner of a suspension smelting furnace, which enables the feed of solid finely divided material into the furnace to be distributed evenly in the concentrate burner. According to the invention, a vibrating feeder is located between the raw material conveyor and the actual burner, and the concentrate burner feed pipes are equipped with blades for dividing the material.

In a suspension-smelting furnace, the feed of pulverous material such as concentrate, flux and flue dust takes place via the concentrate burner situated on top of the reaction shaft of the furnace. For the sake of simplicity, the term concentrate will be used hereafter in the text to mean all the pulverous material fed into the furnace via the concentrate burner. It is extremely important for the successful operation of the concentrate burner that the concentrate and the process air are mixed evenly as they are discharged from the burner into the reaction space i.e. the upper section of the reaction shaft of the suspension smelting furnace. If this is not the case, the result is on the one hand an area of under-reacted concentrate where the concentrate is above the targeted process-air/concentrate ratio and, on the other hand, an area of over-reacted concentrate where the concentrate is below the targeted process-air/concentrate ratio, whereby a large amount of magnetite is produced as from the reactions. Magnetite is slow to dissolve and impairs the quality of the slag produced so that it raises the viscosity of said slag, and the high viscosity in turn slows down the separation of matte and slag in the lower furnace.

Poor concentrate distribution also has a clear effect on the temperature profile of the reaction shaft: hot areas are generated in the furnace, where the autogenic lining formed by the concentrate and protecting the reaction shaft, undergoes great thermal stress and the result, in the worst case scenario, may lead to the destruction of the reaction shaft wall. There have also been indications that dust formation is more marked when the burner does not function well due to poor concentrate distribution.

In currently used solutions, the concentrate is brought to the concentrate burner from the concentrate feed silo mainly by redler or scraper conveyor, from where the raw material flow for discharge is taken first to the concentrate burner hopper and from there along the concentrate feed pipes to the actual concentrate burner itself. The equipment is constructed in accordance with the spaces being used, so the conveyor and concentrate pipes may be at a 90° angle to each other, whereby in changing the direction of flow in the concentrate burner hopper, the concentrate, which is in a slightly fluidized state, behaves like a liquid, and the flow and especially the distribution of the concentrate in the cross-sectional area of the concentrate pipe is uneven, further weakening the distribution of the concentrate in the burner.

In most cases the concentrate is taken to the concentrate burner using two separate concentrate conveyors. In these cases the concentrate distribution to the burner is dependent on the sychronization of the conveyors. Long-term operation with only one conveyor causes similar problems as above as the concentrate is distributed unevenly in the concentrate feed pipes.

An equipment for the evening out of pulverous material feed to a concentrate burner of a suspension smelting furnace has now been developed to solve the problems described above. The raw material flow discharging from the concentrate conveyor is fed to a short vibrating feeder just before the actual burner, where the frequency of said feeder is adjusted so that the concentrate is slightly packed down in the feeder, and is therefore distributed evenly along the horizontal surface of the feeder. It is preferable to equip the concentrate feed pipes, which feed the raw material from the vibrating feeder to the concentrate burner, with partitions. The essential features of the invention will be made apparent in the attached patent claims.

The vibrating feeder belonging to the concentrate burner feed equipment is located in relation to the actual concentrate burner so that the flow of concentrate coming from the feeder is perpendicular to the vertical axis of the burner, whereby the concentrate flow can be distributed evenly after the feeder in the desired amount. Although changing the direction of the concentrate flow was considered a drawback above, in this case it is not, as the concentrate pipes positioned after the vibrating feeder are equipped with partitions, which divide the concentrate evenly over the whole cross-sectional area of the pipes. The divide is further ensured by making small spreaders in the feeder, which improve the exact dispersion in certain points. The concentrate distribution achieved by the vibrating feeder is preserved by dividing the feed pipes from the vibrating feeder to the concentrate burner with partitions, or blades.

The feed equipment according to the present invention as described above works excellently in the case of a single feeder, evening out the flow of concentrate over both time and place. If, however, the arrangement includes two concentrate conveyors and it is wished to operate them asynchronously, the result is once again an uneven distribution of raw material. This situation can be resolved in two ways, depending on whether asynchronous feeding is a regular or rare occurrence.

If an asynchronous feed is desired or obliged to be used on a fairly regular basis, it is preferable to divide both sides of the concentrate intake area of the concentrate burner itself into four segments so that material enters the four segments of the annular discharge channel evenly distributed.

The realization of the equipment modification detailed above in older burner types, however, requires substantial changes. Therefore, in old concentrate burners and in cases where operation with one feeder occurs rarely, it is easier to stop the process and to furnish the concentrate burner feed pipes and the discharge channel with extra blades on the inside, to divide the feed coming from one side only into four sections. The blades are designed so that they can be used in reverse, regardless of which of the two concentrate feeders is in operation.

The equipment arrangement according to the present invention is described further with the attached drawings, where FIG. 1 shows a basic diagram of a suspension smelting furnace and its feed equipment.

Figure 2:
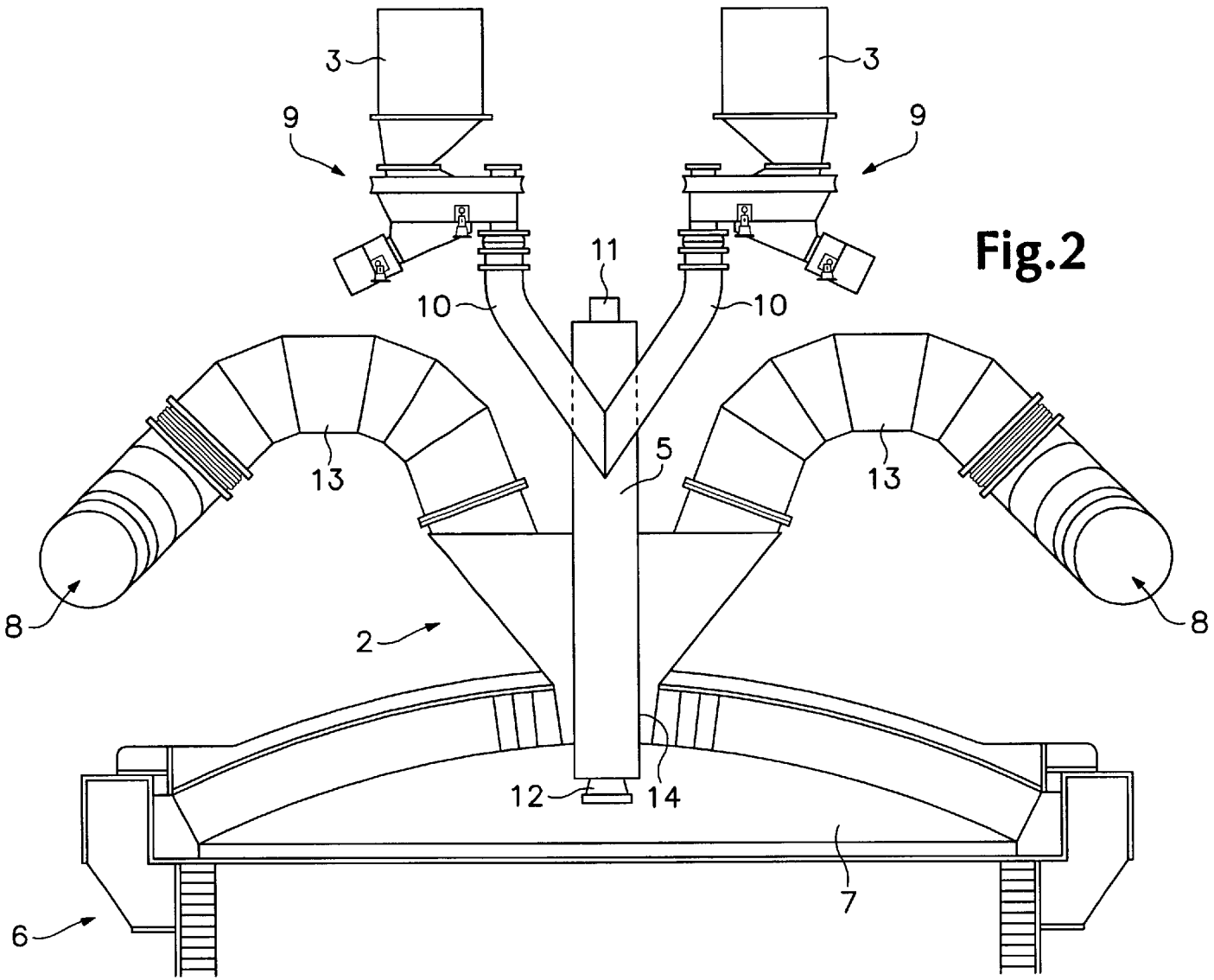
Figure 3A:
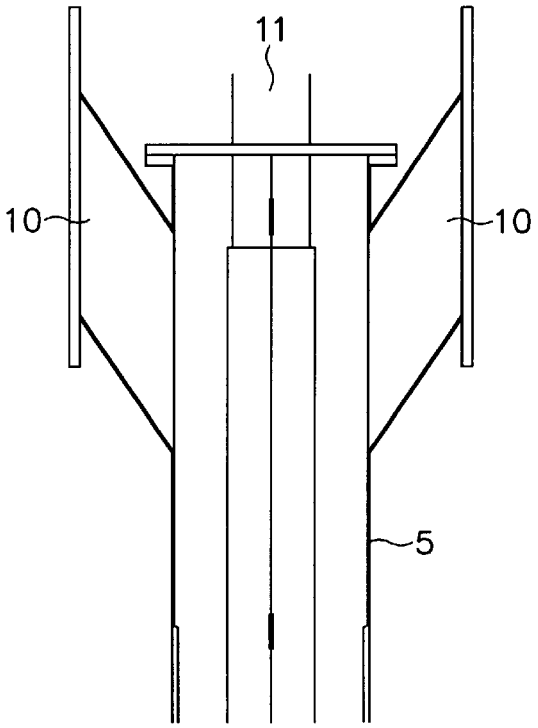
Figure 4A:
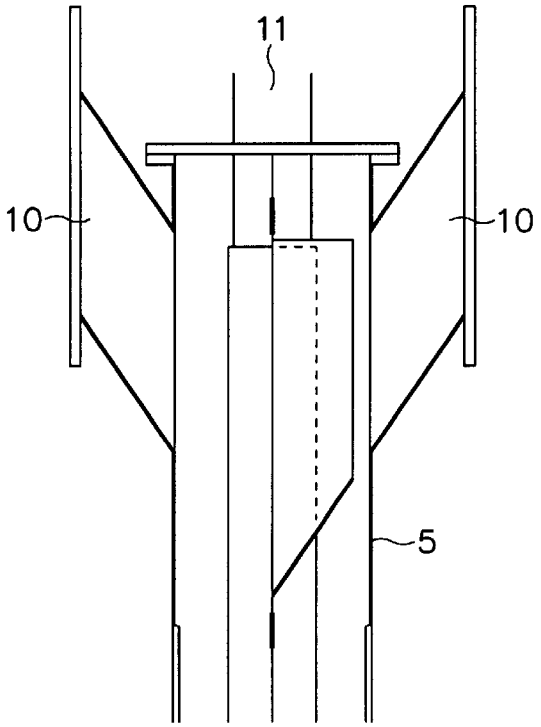
Figure 3B:
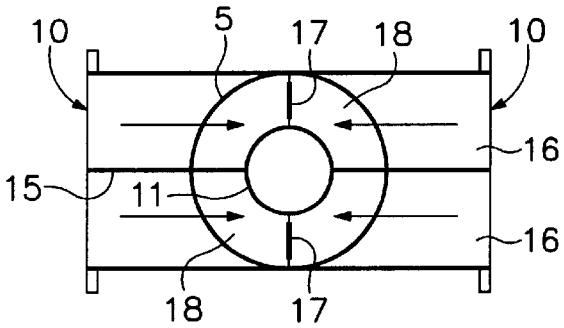
Figure 4B:
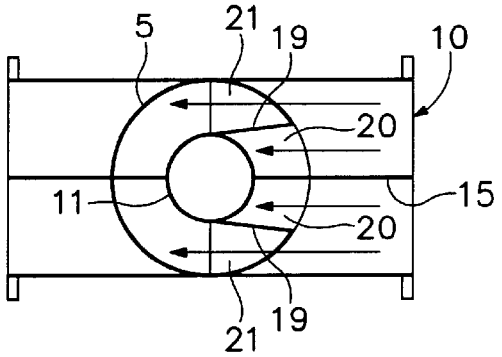
Figure 5A:
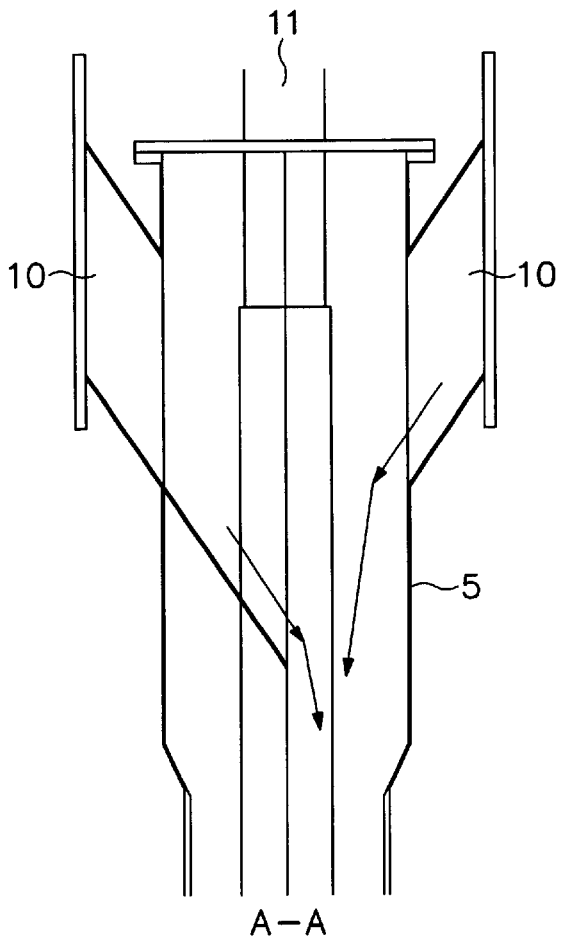
Figure 5B:
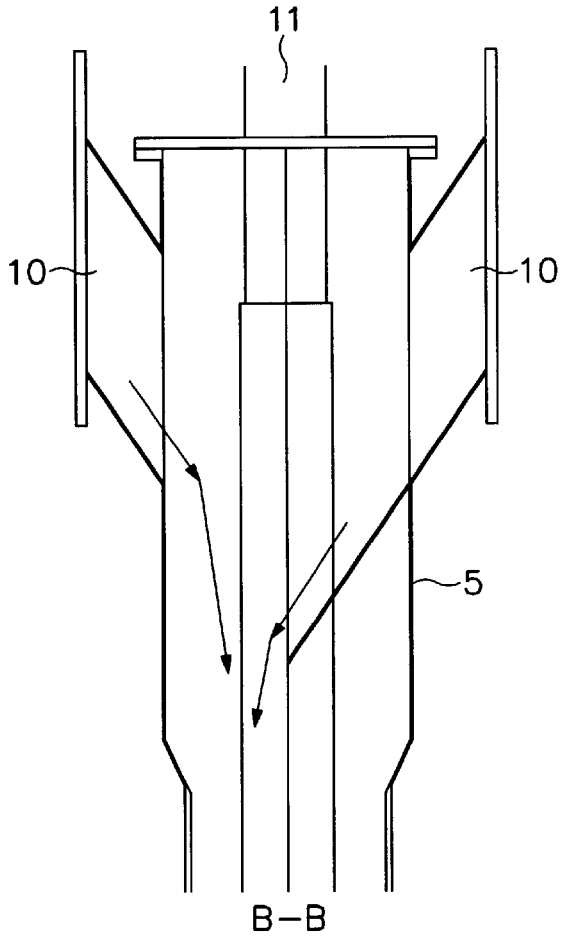
Figure 5C:
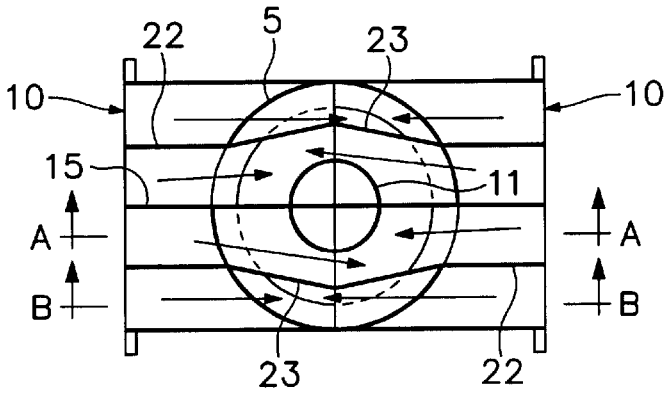

FIG. 2 is a vertical section of the feed equipment of a concentrate burner according to the present invention, FIGS. 3A and 3B are a side view and cross-section of a certain arrangement of concentrate feed pipes and discharge channel, FIGS. 4A and 4B are a side view and cross-section of another alternative, and in FIGS. 5A, 5B and 5C FIG. A is a vertical section, B is a side view of different points of concentrate feed pipes and a discharge channel and C is the corresponding cross-section of one alternative according to the present invention.

FIG. 1 shows a flash-smelting furnace 1, into which pulverous solid material is fed via a concentrate burner 2. The concentrate is transferred from, a tank 3 on a conveyor 4 to the upper section of a discharge channel 5, so that the material falls as a continuous flow through said channel 5 to the upper section 7 of reaction shaft 6 of the furnace 1. Reaction gas is routed via gas feed elements 8 around the concentrate channel parallel to the reaction shaft into its upper part.

FIG. 2 shows in more detail an equipment for the even distribution of concentrate to the burner according to the present invention where the feed of both concentrate and reaction gas occurs from two directions. The concentrate is taken by conveyor to the concentrate tanks 3, which are connected at its lower section to vibrating feeders 9. The vibrating feeders are further equipped with spreaders to ensure the even distribution of the concentrate, but the spreaders are not shown in the drawing. The vibrating feeders in turn are connected to concentrate feed pipes 10, from where the concentrate flows down into the discharge channel 5. A concentrate distributor 11 is located in the centre of the discharge channel. The lower section of a sliding surface 12 is perforated with holes through which air fed horizontally spreads the concentrate flow upwards. Since the concentrate distributor is known in the prior art, the equipment related to it is not shown in more detail.

The gas feed arrangement 13 for the concentrate burner is also bipartite in its upper section and combines at the base into an annular feed device 14 around the concentrate discharge channel 5. The gas discharges from said arrangement into the upper section 7 of the reaction shaft. The burner is made up in its entirety of the reaction gas feed elements, the concentrate feed elements and centrally located concentrate distributor, and if required, extra fuel and/or extra gas feed elements can be placed inside the concentrate distributor.

FIGS. 3A and 3B present one way in which the concentrate feed may be evened out, by furnishing the concentrate feed pipes with partitions, when the concentrate feed comes from two feed pipes 10 in opposing directions, into discharge channel 5. The feed pipes are furnished with a partition 15, which divides the pipes essentially into two equally large channels 16. The partitions inside the discharge channel extend as far as concentrate distributor 11. Partitions, or blades 17, are also made in the discharge channel 5, perpendicularly to the feed pipe partitions. Thus the flow of concentrate is divided into the furnace through four segments 18, symmetrical to each other. Where required, the segments, or sectors, may be of different sizes in relation to each other.

FIGS. 4A and 4B present a feed arrangement where the concentrate feed comes from only one feed pipe. In this case the feed pipe 10 is also divided with a partition 15 extending to the concentrate distributor 11. The discharge channel 5 is additionally divided by blades 19 also into four segments up to the concentrate burner which blades are in more or less the same direction with the feed pipe partition 15. Of these four segments, the innermost segments 20 (seen from the concentrate flow) are smaller in cross-section than the outermost segments 21. In addition, the unused feed pipe partition functions as a continuous partition between the segments. Should there be no second feed pipe, the rear of the discharge channel (seen from the concentrate flow) is divided into two by a plate in the same direction as the feed pipe partition 15. Differently sized segments may cause a certain degree of unevenness in the feed distribution, but this solution is generally intended to be a temporary one, and in any case, it offers a better result than the previously used, undivided discharge channel.

FIGS. 5A, 5B and 5C show another alternative according to the present invention, where the concentrate pipes 10 are divided with several partitions. The central partitions 15 are positioned radially in the discharge channel to divide the concentrate pipes and the discharge channel into two sectors as in the earlier solutions. In this case, the outer partitions 22 of the concentrate pipes are basically parallel to the central partition 15. The blades 23 inside the discharge channel are also mainly parallel to the outer partitions of the concentrate pipes but do not extend to the concentrate distributor 11. They are positioned between the wall of the discharge channel and the concentrate distributor. It is evident that the shape of the blades can be modified somewhat without altering the idea of the invention.

What is claimed is:

1. Apparatus for feeding reaction gas and pulverous solids to a suspension smelting furnace, comprising:

an annular discharge channel for receiving pulverous solids and reaction gas and discharging the solids and gas into the suspension smelting furnace, reaction gas feed elements for feeding the reaction gas into the discharge channel, a pulverous material feed pipe for feeding a flow of the pulverous solids into the discharge channel, at least one partition located in the pulverous material feed pipe for dividing the flow of pulverous material in the feed pipe, and blades positioned in the discharge channel for dividing the flow of pulverous material in the discharge channel.

2. Apparatus according to claim 1, comprising a tank for supplying pulverous material and a vibratory feeder for feeding pulverous material from the tank to the pulverous material feed pipe.

3. Apparatus according to claim 1, wherein the annular discharge channel is defined between an outer pipe and a concentrate distributor located within the outer pipe.

4. Apparatus according to claim 3, wherein the feed pipe opens into the annular discharge channel and the partition is centrally located in the feed pipe and extends into the discharge channel as far as the concentrate distributor.

5. Apparatus according to claim 4, wherein the blades positioned in the discharge channel extend to the concentrate distributor.

6. Apparatus according to claim 3, wherein the partition is centrally located in the feed pipe and the blades positioned in the discharge channel are substantially parallel to the partition and extend to the concentrate distributor.

7. Apparatus according to claim 1, wherein the partition is centrally located in the feed pipe and the blades positioned in the discharge channel are substantially parallel to the partition.

8. Apparatus according to claim 1, wherein the blades are substantially perpendicular to the partition.

9. Apparatus according to claim 1, comprising first and second pulverous material feed pipes for feeding the pulverous solids into the discharge channel at opposite respective sides thereof.

10. Apparatus according to claim 1, comprising a plurality of partitions located in the pulverous material feed pipe for dividing pulverous material flowing to the discharge channel, the partitions being substantially parallel to each other.

11. Apparatus according to claim 10, wherein the blades are substantially parallel to the partitions.

12. Apparatus according to claim 1, comprising first and second pulverous material feed pipes for feeding the pulverous solids into the discharge channel at opposite respective sides thereof, first and second tanks for supplying pulverous material and first and second vibratory feeders for feeding pulverous material from the first and second tanks to the first and second pulverous material feed pipes respectively.

13. Apparatus according to claim 1, wherein the annular discharge channel is defined between an outer pipe and a concentrate distributor located within the outer pipe and is substantially vertical, and the partition and the blades are substantially vertical.

* * * * *